US009963309B2

(12) United States Patent
Suzuki

(10) Patent No.: US 9,963,309 B2
(45) Date of Patent: May 8, 2018

(54) IMAGE FORMING APPARATUS INCORPORATING TEMPORARY RETAINER FOR BYPASS TRAY

(71) Applicant: Kenta Suzuki, Kanagawa (JP)

(72) Inventor: Kenta Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/205,412

(22) Filed: Jul. 8, 2016

(65) Prior Publication Data

US 2017/0015511 A1 Jan. 19, 2017

(30) Foreign Application Priority Data

Jul. 13, 2015 (JP) ..... 2015-139476

(51) Int. Cl.

| | |
|---|---|
| ***B65H 1/04*** | (2006.01) |
| ***B65H 11/00*** | (2006.01) |
| ***B65H 3/44*** | (2006.01) |
| ***G03G 15/00*** | (2006.01) |

(52) U.S. Cl.

CPC ..... *B65H 1/04* (2013.01); *B65H 3/44* (2013.01); *G03G 15/6514* (2013.01); *B65H 2402/30* (2013.01); *B65H 2405/11162* (2013.01); *B65H 2405/11164* (2013.01); *B65H 2405/324* (2013.01); *B65H 2407/21* (2013.01); *B65H 2801/06* (2013.01)

(58) Field of Classification Search

CPC ..... B65H 1/04; B65H 2405/324; B65H 2405/11162; B65H 2405/111646; B65H 2405/111643; B65H 3/44; B65H 2407/21; G03G 15/6514; G03G 2215/00392

See application file for complete search history.

(56) References Cited

FOREIGN PATENT DOCUMENTS

| | | | |
|---|---|---|---|
| JP | 07097102 A | * | 4/1995 |
| JP | 7-309454 | | 11/1995 |
| JP | 2002193497 A | * | 7/2002 |
| JP | 2006-124146 | | 5/2006 |
| JP | 2007-218950 | | 8/2007 |
| JP | 2007238282 A | * | 9/2007 |
| JP | 2011136842 A | * | 7/2011 |

* cited by examiner

*Primary Examiner* — Luis A Gonzalez
(74) *Attorney, Agent, or Firm* — Harness, Dickey & Pierce P.L.C.

(57) ABSTRACT

An image forming apparatus includes an apparatus body, an image forming portion, a sheet feeding port, a bypass tray, a rotation support, and a temporary retainer. The image forming portion is disposed in the apparatus body to form an image on a recording medium. The sheet feeding port is disposed upstream from the image forming portion of the apparatus body in a sheet feeding direction. The bypass tray is disposed to be storable in the apparatus body. The bypass tray loads the recording medium to be fed toward the sheet feeding port. The rotation support supports the bypass tray. The temporary retainer positions the bypass tray both in a vertical direction relative to the sheet feeding port and in a perpendicular direction perpendicular to the sheet feeding direction. The temporary retainer temporarily retains the bypass tray.

13 Claims, 12 Drawing Sheets

IMAGE FORMING APPARATUS INCORPORATING TEMPORARY RETAINER FOR BYPASS TRAY

CROSS-REFERENCE TO RELATED APPLICATION

This patent application is based on and claims priority pursuant to 35 U.S.C. § 119(a) to Japanese Patent Application No. 2015-139476, filed on Jul. 13, 2015, in the Japan Patent Office, the entire disclosure of which is hereby incorporated by reference herein.

BACKGROUND

Technical Field

This disclosure relates to an image forming apparatus that incorporates a temporary retainer to hold a bypass tray detachably attachable to an apparatus body.

Related Art

Various types of image forming apparatuses include copiers, printers, facsimile machines, or multifunction peripherals (MFPs) having two or more of copying, printing, scanning, facsimile transmission, plotter, and other capabilities. Such electrophotographic image forming apparatuses include a bypass tray on which a user can set a desired sheet appropriately. Such a bypass tray is moved to separate from an apparatus body of an image forming apparatus to open when the bypass tray is to be used. A hinge, for example, is provided to support the bypass tray rotatably, so that the bypass tray is stowed in the apparatus body when the bypass tray is not used.

A comparative image forming apparatus includes a comparative bypass tray that is prevented from being shifted with respect to the apparatus body of the image forming apparatus. Consequently, the comparative bypass tray includes a tray positioning mechanism provided to both the bypass tray and the apparatus body. The tray positioning mechanism includes a tray movement regulator that regulates movements of the bypass tray with respect to the apparatus body in a tray width direction.

SUMMARY

At least one aspect of this disclosure provides an image forming apparatus including an apparatus body, an image forming portion, a sheet feeding port, a bypass tray, a rotation support, and a temporary retainer. The image forming portion is disposed in the apparatus body to form an image on a recording medium. The sheet feeding port is disposed upstream from the image forming portion of the apparatus body in a sheet feeding direction. The bypass tray is disposed to be storable in the apparatus body. The bypass tray loads the recording medium to be fed toward the sheet feeding port. The rotation support supports the bypass tray. The temporary retainer positions the bypass tray both in a vertical direction relative to the sheet feeding port and in a perpendicular direction perpendicular to the sheet feeding direction. The temporary retainer temporarily retains the bypass tray.

DETAILED DESCRIPTION

Figure 1:
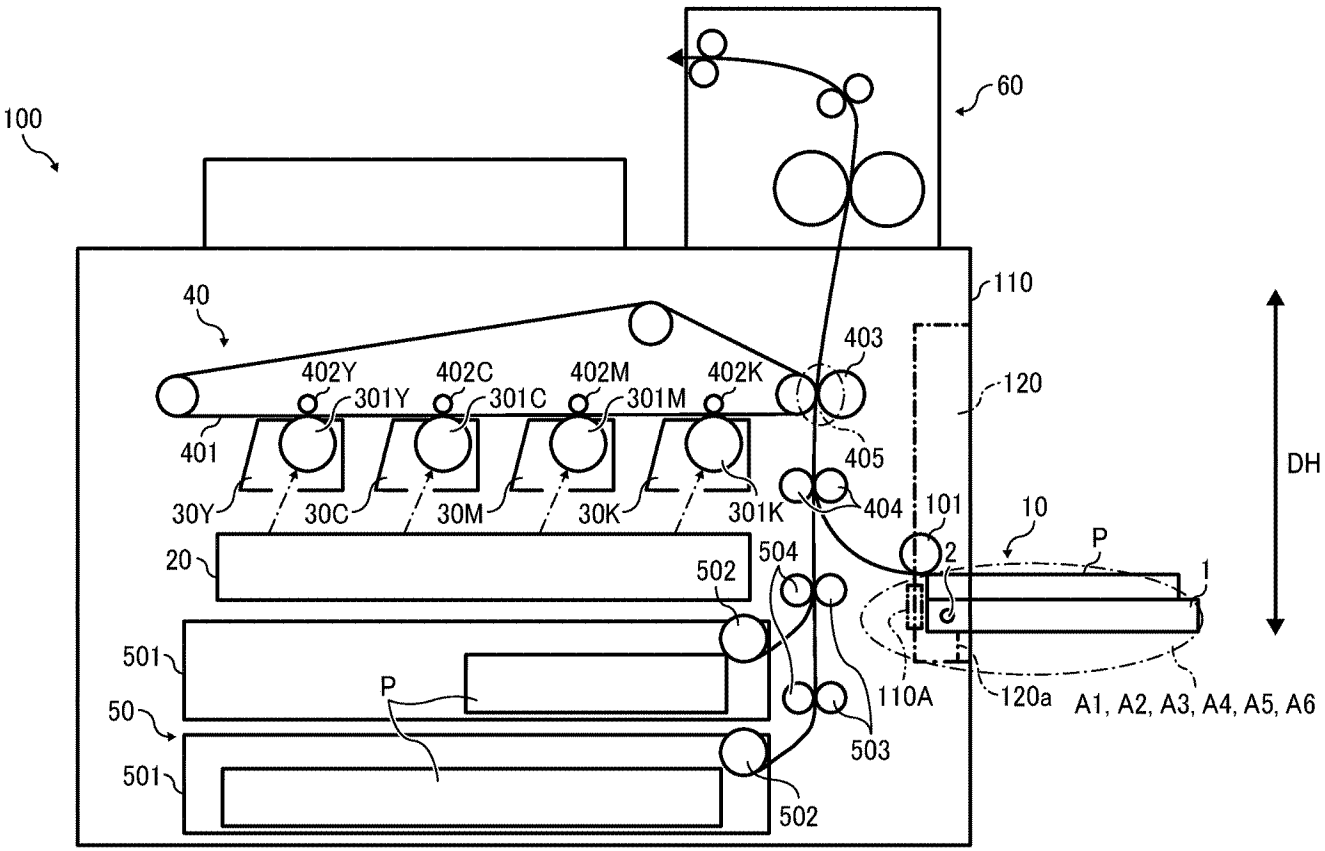
FIG. 1 is a schematic diagram illustrating an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of an entire configuration and functions of an image forming apparatus 100 according to an embodiment of this disclosure.

A description is given of an image forming apparatus 100 according to an embodiment of this disclosure, with reference to the drawings.

It is to be noted that identical parts are given identical reference numerals and redundant descriptions are summarized or omitted accordingly.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

Figure 2:
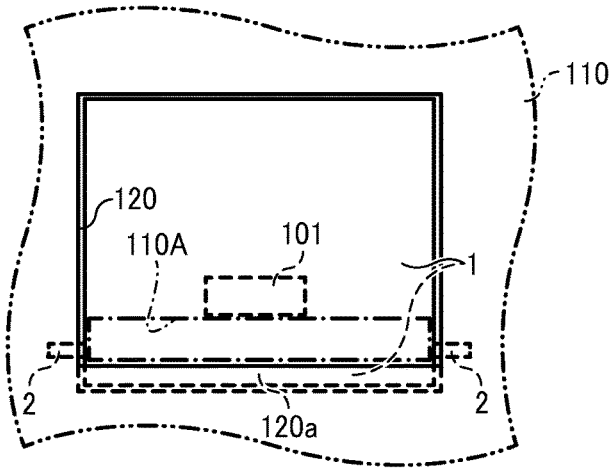
FIG. 2 is a front view illustrating a bypass tray closed and stowed in an apparatus body of the image forming apparatus according to an embodiment of this disclosure.

FIG. 1 is a diagram illustrating a schematic configuration of the image forming apparatus 100 according to an embodiment of this disclosure. FIG. 2 is a front view illustrating a bypass tray 1 closed and stowed in an apparatus body 110 of the image forming apparatus 100 according to an embodiment of this disclosure.

The image forming apparatus 100 in FIG. 1 functions as a printer that forms a full color image. The image forming apparatus 100 includes a bypass sheet feeder 10, an optical writing device 20, four process cartridges 30Y, 30M, 30C, and 30K, a transfer device 40, a sheet bank 50, and a fixing device 60.

It is to be noted that suffixes to distinguish colors of toners are attached to respective reference numerals such as process cartridge 30Y. The process cartridges 30Y, 30M, 30C, and 30K have substantially the same configuration except for containing different color toners of yellow (Y), magenta (M), cyan (C), and black (K) corresponding to color separation components of a color toner. Therefore, the process cartridges 30Y, 30M, 30C, and 30K and related parts and components are described without suffixes. For example, the process cartridges 30Y, 30M, 30C, and 30K are hereinafter referred to in a singular form occasionally, for example, the "process cartridge 30".

The process cartridge 30 (i.e., the process cartridges 30Y, 30M, 30C, and 30K) includes a photoconductor drum 301 (i.e., photoconductor drums 301Y, 301M, 301C, and 301K).

The process cartridge 30 (i.e., the process cartridges 30Y, 30M, 30C, and 30K) includes a photoconductor drum 301 (i.e., photoconductor drums 301Y, 301M, 301C, and 301K). In the process cartridge 30, the electrostatic latent image formed on the surface of the photoconductor drum 301 is developed to a visible toner image.

The transfer device 40 includes an intermediate transfer belt 401, primary transfer rollers 402Y, 402M, 402C, and 402K, a secondary transfer roller 403, and a pair of registration rollers 404. The intermediate transfer belt 401 is an endless belt wound around multiple support rollers.

The intermediate transfer belt 401 is disposed above the process cartridges 30Y, 30M, 30C, and 30K and along a moving direction of the respective surfaces of the photoconductor drums 301Y, 301M, 301C, and 301K. The intermediate transfer belt 401 moves in synchronization with movement of the surface of the photoconductor drum 301 (i.e., the photoconductor drums 301Y, 301M, 301C, and 301K).

Further, the primary transfer roller 402 (i.e., the primary transfer rollers 402Y, 402M, 402C, and 402K) presses the intermediate transfer belt 401 against an outer circumferential surface of the photoconductor drum 301 (i.e., the photoconductor drums 301Y, 301M, 301C, and 301K). Accordingly, four single color toner images on the respective surfaces of the process cartridges 30Y, 30M, 30C, and 30K are sequentially transferred and overlaid onto a surface of the intermediate transfer belt 401.

The bypass sheet feeder 10 includes a bypass tray 1, a sheet feed roller 101, and temporary retainers A1 through A6. The bypass tray 1 is a manual feed tray on which a user sets a sheet P manually. The temporary retainers A1 through A6 temporarily retain the bypass tray 1. Details of the temporary retainers A1 through A6 are described below.

The image forming apparatus 100 further includes an apparatus body 110, a tray storing portion 120, and a bypass tray movement support shaft 2. The tray storing portion 120 is a portion in which the bypass tray 1 is stowed. The bypass tray 1 is rotatably supported at a lower part of the tray storing portion 120 by the bypass tray movement support shaft 2 relative to the apparatus body 110. The bypass tray movement support shaft 2 functions as a rotation support body, for example.

The bypass tray 1 rotates about the bypass tray movement support shaft 2 when the bypass tray 1 is not used. By so doing, the bypass tray 1 can be stored in the tray storing portion 120. The tray storing portion 120 includes a frame 120*a* at a lower part thereof.

Further, when the bypass tray 1 is used, the bypass tray 1 is rotated by substantially 90 degrees outwardly from the tray storing portion 120. As the bypass tray 1 rotates about the bypass tray movement support shaft 2 outwardly to separate from the tray storing portion 120, a shaft side (a lower side) of a rear face (an outer face) of the bypass tray 1 contacts the frame 120*a* of the tray storing portion 120. By so doing, the bypass tray 1 is held in an open state, as illustrated in FIG. 1. Accordingly, in this state as illustrated in FIG. 2, an edge of the bypass tray 1 close to the apparatus body 110 is located facing an apparatus body side sheet insertion port 110A disposed between the sheet feed roller 101 and the frame 120*a*. Further, the sheet P is loaded on the bypass tray 1.

It is to be noted that, in the present embodiment, the frame 120*a* is provided as the temporary retainers A2 through A6. In addition, a direction of height of the image forming apparatus 100 including the bypass tray 1 according to the present embodiment corresponds to a vertical direction DH as illustrated in FIG. 1.

The sheet P that is loaded on the bypass tray 1 is fed by the sheet feed roller 101 toward the pair of registration rollers 404 of the transfer device 40.

Further, the sheet bank 50 includes sheet trays 501 and sheet feed rollers 502. Each of the sheet trays 501 accommodates the sheet P therein. The sheet P is fed by a selected one of the sheet feed rollers 502 to sheet conveying rollers 503 and 504 by which the sheet P is conveyed to the pair of registration rollers 404 of the transfer device 40.

The pair of registration rollers 404 receives and holds the sheet P that functions as a recording medium fed from a selected one of the bypass sheet feeder 10 and the sheet bank 50. Then, the pair of registration rollers 404 conveys the sheet P toward a nip region 405 between the intermediate transfer belt 401 and the secondary transfer roller 403 at a predetermined timing. The toner image borne on the intermediate transfer belt 401 is transferred onto the sheet P in the nip region 405 and conveyed to the fixing device 60. In the fixing device 60, the toner image on the sheet P is fixed to the sheet P. Consequently, the sheet P having the fixed toner image is ejected to a sheet ejection part. It is to be noted that the nip region 405 between the intermediate transfer belt 401 and the secondary transfer roller 403 functions as an example of an image forming portion. The apparatus body side sheet insertion port 110A is located before the nip region 405, that is, is disposed upstream from the nip region 405 in a sheet conveying direction.

Next, a description is given of the temporary retainers A1 through A6 according to each of Examples 1 through 6.

It is to be noted that identical reference numerals are given to identical parts and components in Examples 1 through 6, and redundant descriptions are summarized or omitted accordingly.

Example 1

Figure 3:
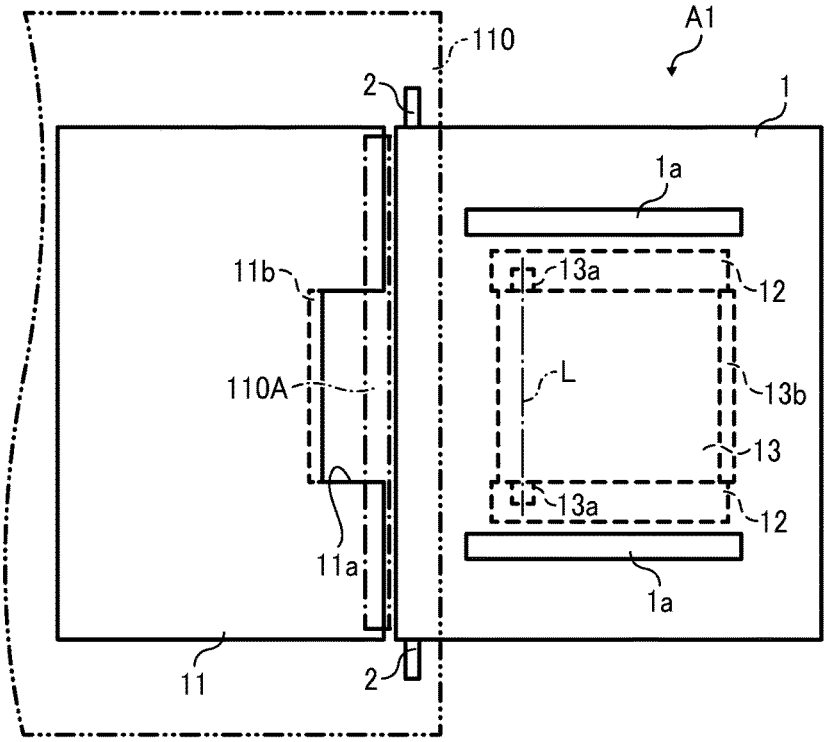
FIG. 3 is a top view illustrating a temporary retainer according to Example 1.
Figure 4:
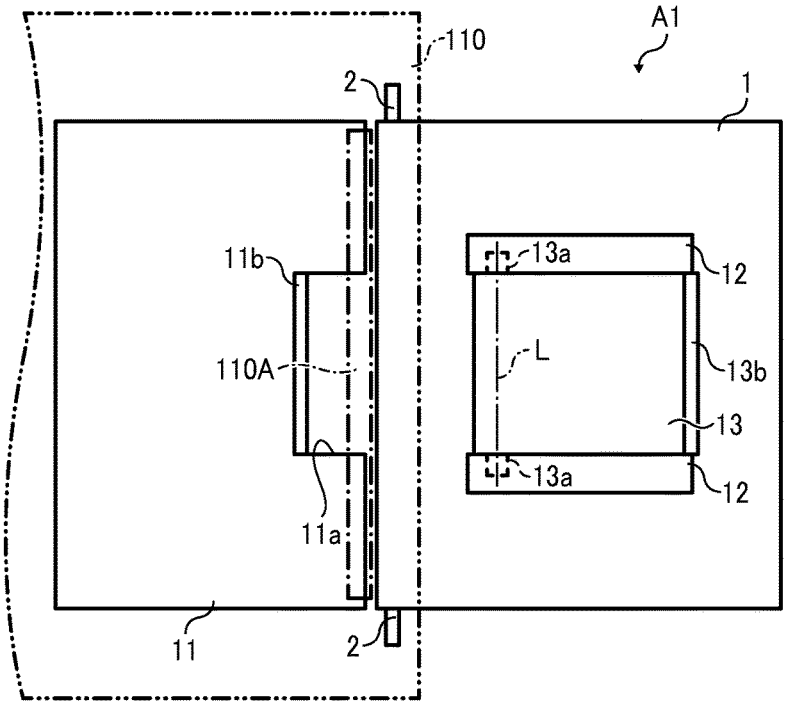
FIG. 4 is a bottom view illustrating the temporary retainer of Example 1 in a first state.
Figure 5:
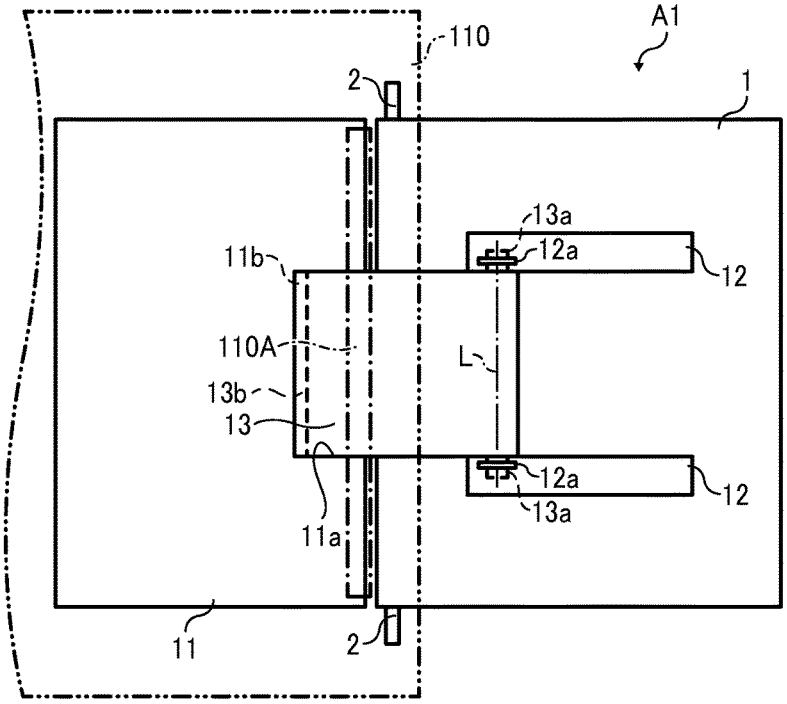
FIG. 5 is a bottom view illustrating the temporary retainer of Example 1 in a second state.
Figure 6:
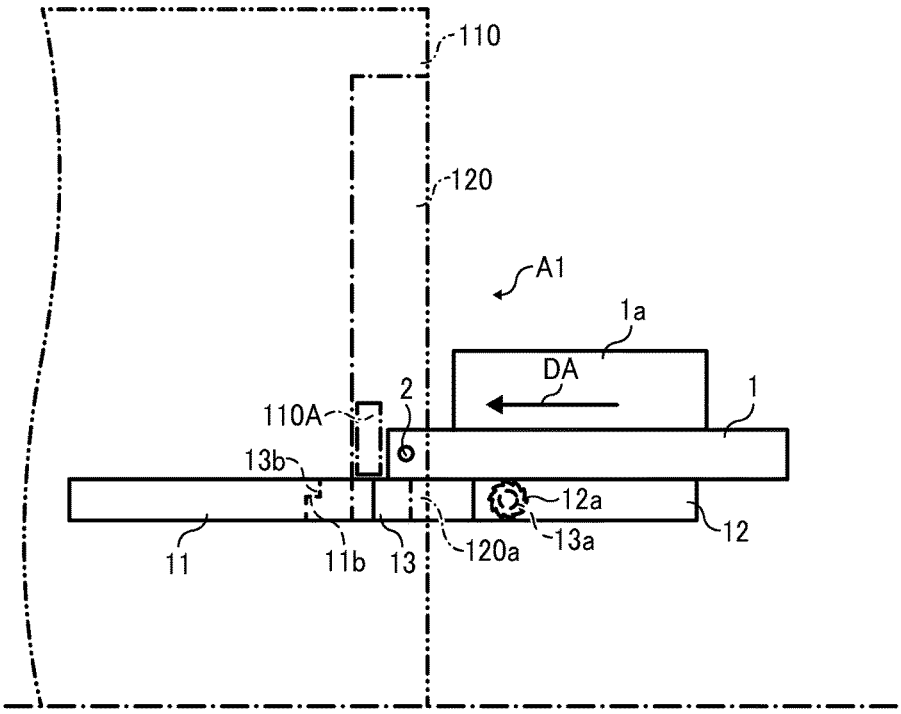
FIG. 6 is a front view illustrating the temporary retainer of Example 1 in the second state.
Figure 7:
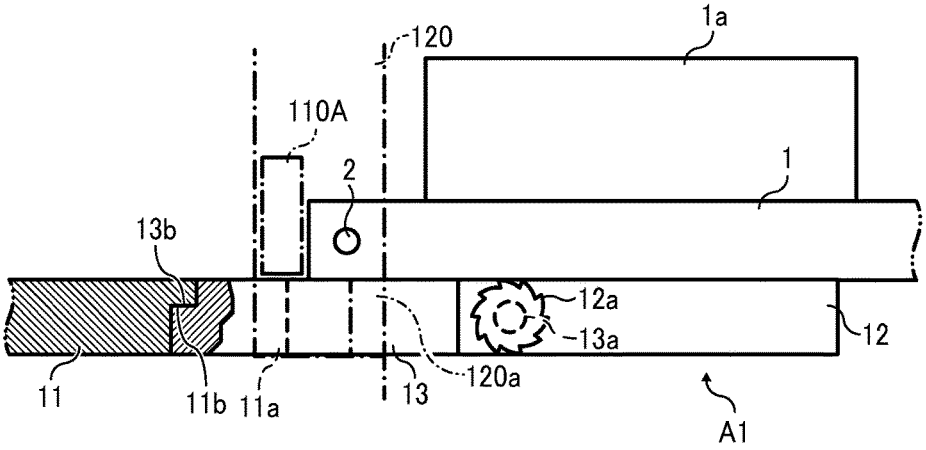
FIG. 7 is a cross sectional view illustrating a detailed part of the temporary retainer of Example 1.

A description is given of the temporary retainer A1 according to Example 1, with reference to FIGS. 3 through 7. FIG. 3 is a top view illustrating the temporary retainer A1. FIG. 4 is a bottom view illustrating the temporary retainer A1 in a first state. FIG. 5 is a bottom view illustrating the temporary retainer A1 in a second state. FIG. 6 is a front view illustrating the temporary retainer A1 in the second state. FIG. 7 is a cross sectional view illustrating a detailed part of the temporary retainer A1.

The temporary retainer A1 according to Example 1 includes a recess 11, a pair of supports 12, and a projection 13. The recess 11 is disposed in the apparatus body 110. The pair of supports 12 is disposed on the rear face of the bypass tray 1. The pair of supports 12 is occasionally referred to as the support 12 individually. The projection 13 includes a support shaft 13*a*. The projection 13 is supported by the pair of supports 12 to be rotatable about the support shaft 13*a* around an axis L.

The recess 11 includes a recessed portion 11*a*. The recessed portion 11*a* having a rectangular shape is disposed close to the bypass tray 1. The projection 13 has a rectangular shape to fit to the recessed portion 11*a*. The recess 11 further includes a step 11*b* at a far edge of the recessed portion 11*a*. The projection 13 further includes a step 13*b* at an edge thereof to fit to the step 11*b* of the recess 11.

It is to be noted that, as illustrated in FIGS. 1 and 5, side fences 1*a* are disposed to regulate a position in a width direction of the sheet P loaded on the bypass tray 1.

As described above, the bypass tray 1 is disposed detachably attachable to the tray storing portion 120 of the apparatus body 110. However, in a comparative bypass tray, an assembling portion of a rotation support such as hinge may be detached from an apparatus body of an image forming apparatus during printing operations using the comparative bypass tray. In such a case, the comparative bypass tray cannot be used before having the comparative bypass tray repaired or replaced by a service representative, for example. Accordingly, in Example 1 according to the embodiment of this disclosure, at the time of failure of the assembling portion of the bypass tray movement support shaft 2, the following processes are taken.

First, when the projection 13 is located as illustrated in FIG. 4, a free end of the projection 13 is rotated to separate from the bypass tray 1. Accordingly, the projection 13 is projected from the bypass tray 1, as illustrated in FIG. 5. It is to be noted that the support 12 includes a ratchet wheel 12*a* to be mounted on the support shaft 13*a* to hold a state in which the projection 13 is disposed projecting from the bypass tray 1. In this state, the projection 13 is fitted to the recessed portion 11*a* of the recess 11 as illustrated in FIGS. 5 and 6. At this time, as illustrated in FIG. 7, the step 13*b* of the projection 13 is fitted to the step 11*b* of the recess 11 and the projection 13 is brought to contact a lower edge of the opening of the tray storing portion 120. It is to be noted that the frame 120*a* includes a cut to which the projection 13 is fitted.

Accordingly, the projection 13 and the bypass tray 1 are supported by the step 11*b* of the recess 11 and the lower edge of the opening of the tray storing portion 120. As a result, the position of the bypass tray 1 in a vertical (height) direction is located to a predetermined position to be held horizontally. Further, since the projection 13 is fitted to the recessed portion 11*a* of the recess 11, the bypass tray 1 can be positioned relative to the apparatus body 110 in a direction perpendicular to the sheet conveying direction DA illustrated in FIG. 6. Hereinafter, the direction perpendicular to the sheet conveying direction DA is also referred to as the "perpendicular direction to the sheet conveying direction DA" occasionally. Accordingly, the bypass tray 1 can be positioned in the vertical direction DH relative to the apparatus body side sheet insertion port 110A of the apparatus body 110 and in the perpendicular direction to the sheet conveying direction DA.

Example 2

A description is given of the temporary retainer A2 according to Example 2, with reference to FIGS. 8 through 11.

Figure 8:
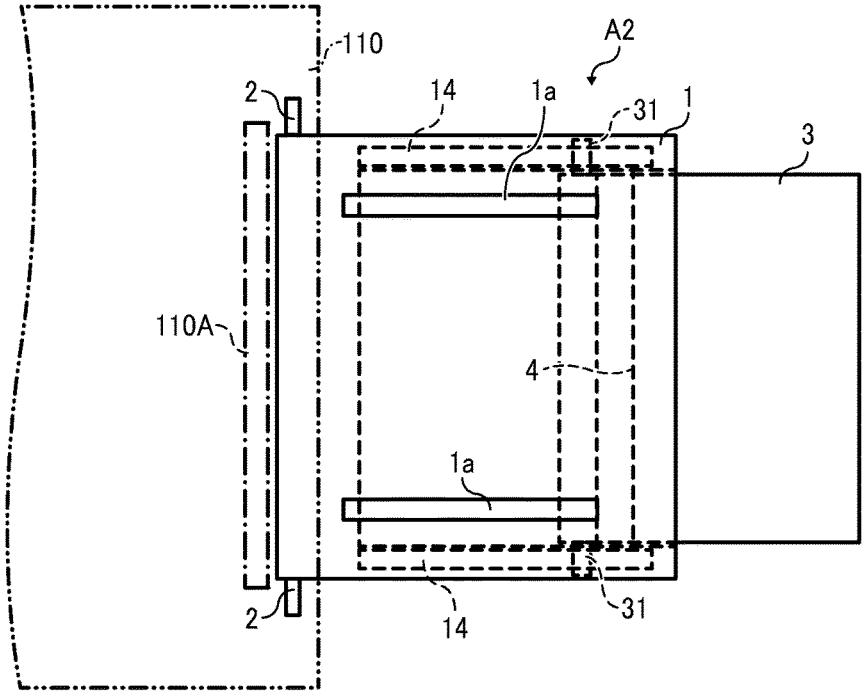
FIG. 8 is a top view illustrating a temporary retainer according to Example 2.
Figure 9:
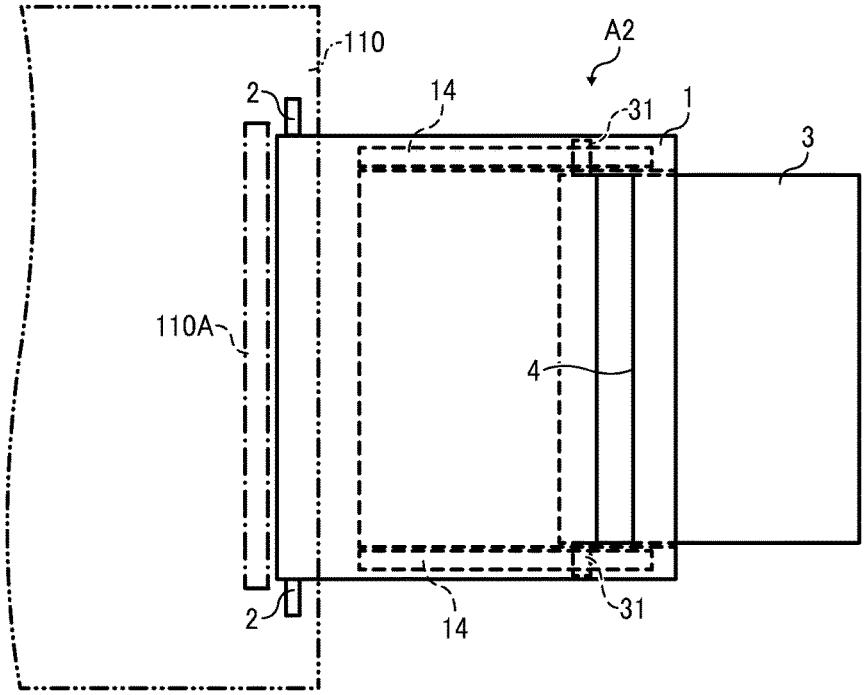
FIG. 9 is a bottom view illustrating the temporary retainer of Example 2.
Figure 10:
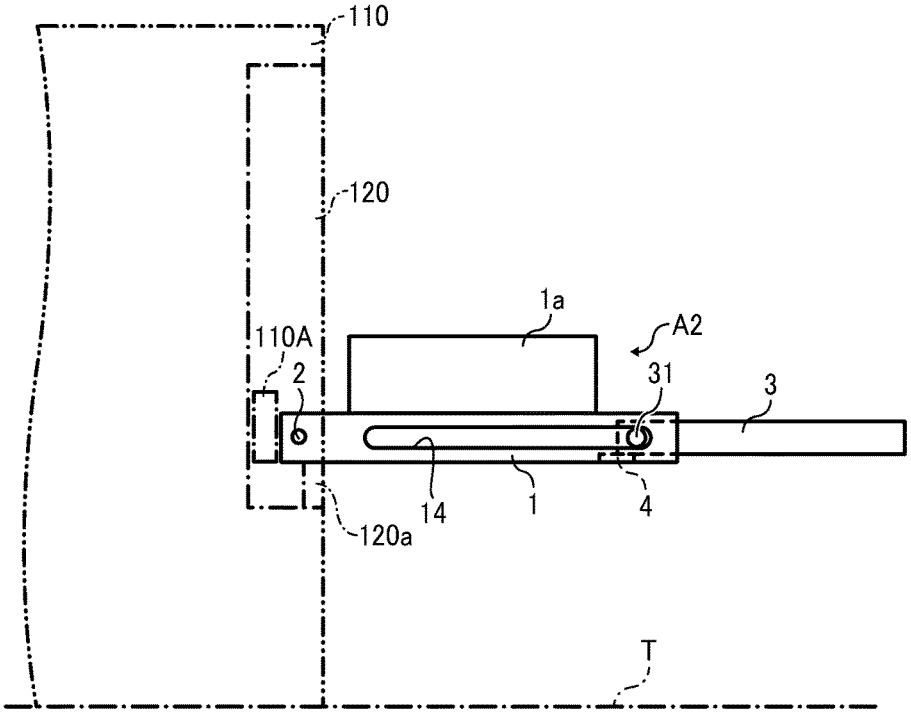
FIG. 10 is a front view illustrating the temporary retainer of Example 2 in the first state.
Figure 11:
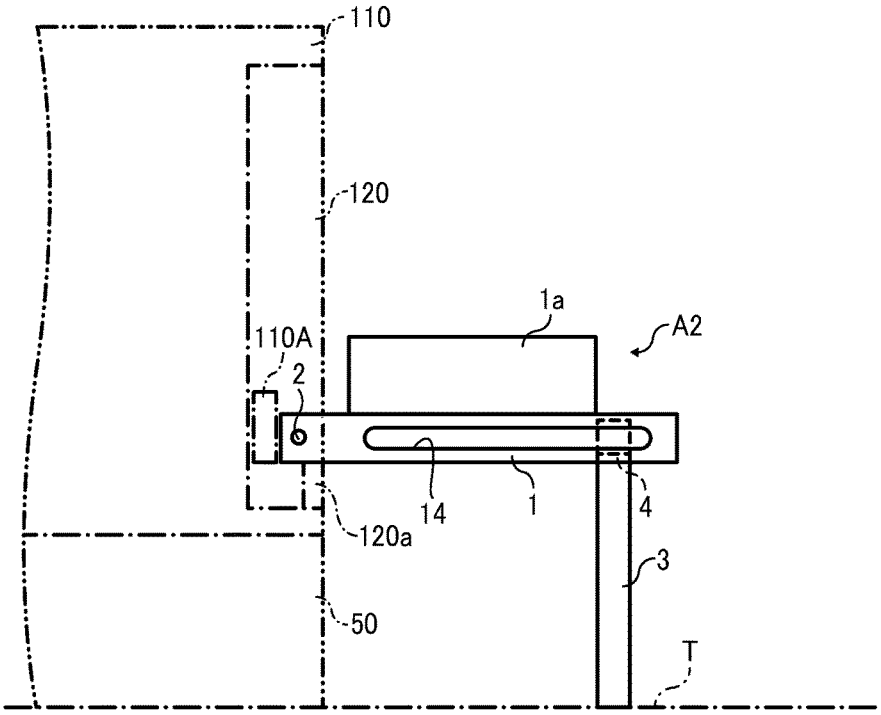
FIG. 11 is a front view illustrating the temporary retainer of Example 2 in the second state.

FIG. 8 is a top view illustrating the temporary retainer A2. FIG. 9 is a bottom view illustrating the temporary retainer A2. FIG. 10 is a front view illustrating the temporary retainer A2 in the first state. FIG. 11 is a front view illustrating the temporary retainer A2 in the second state.

Similar to Example 1, the bypass tray 1 according to Example 2 rotates about the bypass tray movement support shaft 2 when the bypass tray 1 is not used. By so doing, the bypass tray 1 can be stored in the tray storing portion 120.

The bypass tray 1 in Example 2 includes an extension tray 3 that is included in the temporary retainer A2.

The extension tray 3 is stowed in the bypass tray 1 to be slidably removable from the bypass tray 1 along a rail guide or rail guides. Further, the extension tray 3 is freely slidably pulled within a range of a tray slidable range opening 14 on the bypass tray 1. Respective screws 31 mounted on the extension tray 3 contact a right end portion (FIG. 10) of the tray slidable range opening 14, where the extension tray 3 is pulled out to the maximum extent. Accordingly, detachment of the extension tray 3 can be prevented. By removing the screws 31 from the extension tray 3, the extension tray 3 can be removed from the bypass tray 1.

An extension tray insertion opening 4 is formed (disposed) on a back face (an opposite face) of the bypass tray 1. At the time of failure of the assembling portion of the bypass tray movement support shaft 2, the following processes are taken.

As illustrated in FIG. 11, an end portion of the bypass tray 1 is fitted into the tray storing portion 120 of the apparatus body 110, so that the bypass tray 1 is supported while being in contact with the frame 120*a* of the tray storing portion 120. The extension tray 3 removed from the bypass tray 1 is fitted into the extension tray insertion opening 4, so that the extension tray 3 can position the bypass tray 1 in the vertical direction DH from a table T. That is, after the screws 31 of the extension tray 3 has been removed to detach the extension tray 3 from the apparatus body 110, the extension tray 3 is fitted to the extension tray insertion opening 4. At this time, the extension tray 3 functions as a leg to be used for positioning the bypass tray 1 in the vertical direction DH relative to the apparatus body 110. In that case, a height of the bypass tray 1 is previously determined to be a height from the top face of the table T including the sheet bank 50. Accordingly, the bypass tray 1 can be positioned in the vertical direction DH relative to the apparatus body side sheet insertion port 110A of the apparatus body 110 and in the perpendicular direction to the sheet conveying direction DA. The extension tray insertion opening 4 is formed or disposed on an opposite side (an upstream side) of the bypass tray 1 in the sheet conveying direction. In other words, the extension tray insertion opening 4 is formed on a far side of the bypass tray 1 from the apparatus body 110. That is, the extension tray 3 contacts the ground at the opposite side (the upstream side) of the bypass tray 1 in the sheet conveying direction. In other words, the extension tray 3 lands or touches the ground at the far side of the bypass tray 1 from the apparatus body 110.

Example 3

Figure 12:
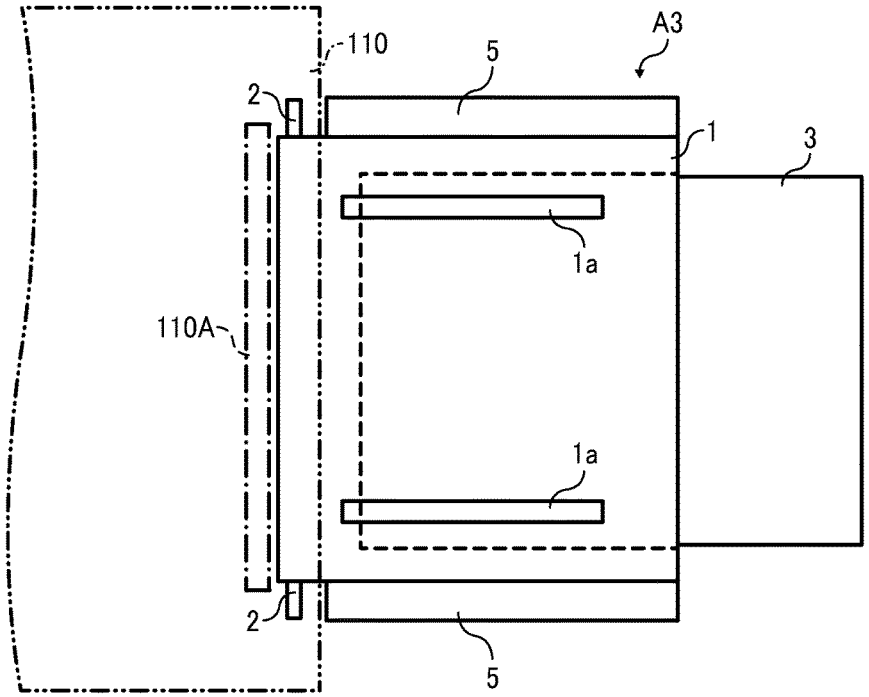
FIG. 12 is a top view illustrating a temporary retainer according to Example 3.
Figure 13:
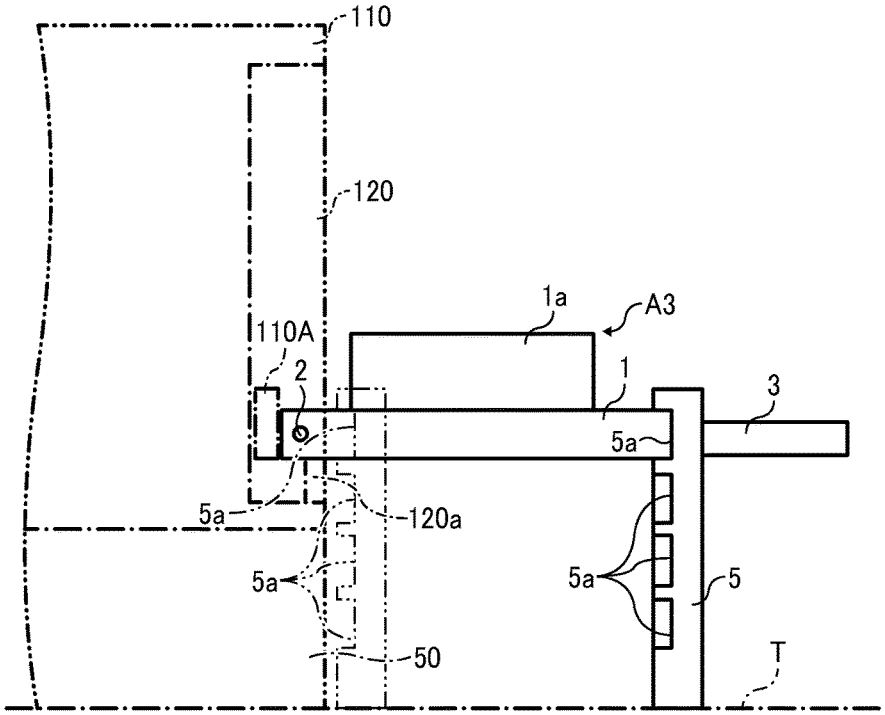
FIG. 13 is a front view illustrating a state of assembling of the temporary retainer of Example 3.

A description is given of the temporary retainer A3 according to Example 3, with reference to FIGS. 12 and 13.

FIG. 12 is a top view illustrating the temporary retainer A3. FIG. 13 is a front view illustrating a state of assembling of the temporary retainer A3.

Similar to Examples 1 and 2, the bypass tray 1 according to Example 3 rotates about the bypass tray movement support shaft 2 when the bypass tray 1 is not used. By so doing, the bypass tray 1 can be stored in the tray storing portion 120. Further, the extension tray 3 is stowed in the bypass tray 1 to be slidably removable from the bypass tray 1 along a rail guide or rail guides. Two, three, or four legs 5 are disposed on both side faces of the bypass tray 1. Each of the legs 5 is detachably attachable to the bypass tray 1 and is included in the temporary retainer A3.

The legs 5 are attached to the bypass tray 1 by a method of fitting parts and components or as a single resin unit that can be separated by pliers, for example. As described above, at the time of failure of the assembling portion of the bypass tray movement support shaft 2, the following processes are taken.

Each of the legs 5 has multiple recesses 5*a*. When the leg 5 is set vertically, a part of the bypass tray 1 is fitted to one of the multiple recesses 5*a*. Accordingly, the bypass tray 1 is retained and held by the leg 5. An appropriate one of the multiple recesses 5*a* is selected to position the bypass tray 1 at an appropriate height. In a case in which the bypass tray movement support shaft 2 is detached from the bypass tray 1, if the bypass tray 1 is to be held in this state, another leg 5 can be added, as illustrated by a broken line in FIG. 13. Accordingly, the bypass tray 1 can be positioned in the vertical direction DH relative to the apparatus body side sheet insertion port 110A of the apparatus body 110 and in the perpendicular direction to the sheet conveying direction DA.

Example 4

A description is given of the temporary retainer A4 according to Example 2, with reference to FIGS. 8 through 11.

Figure 14:
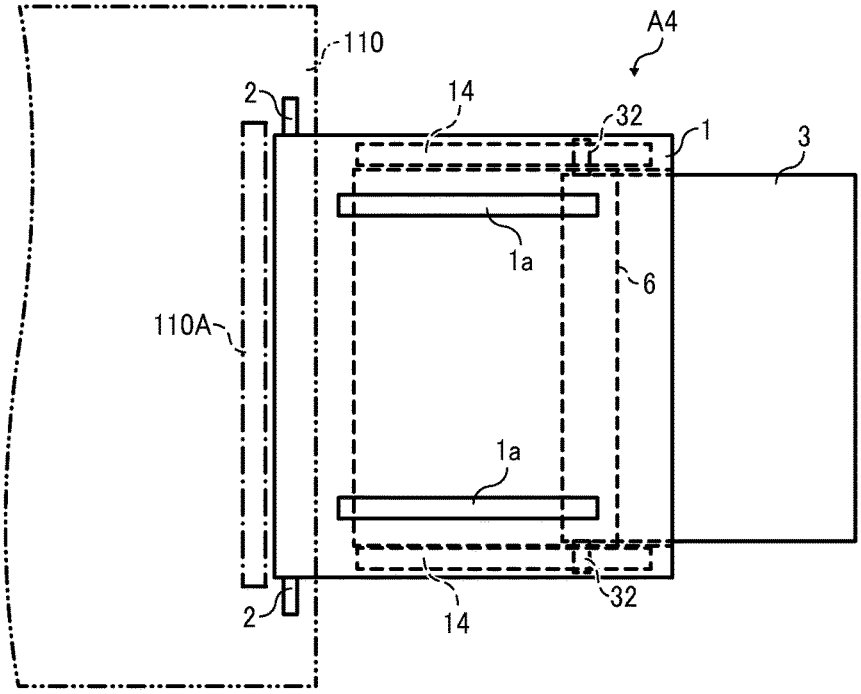
FIG. 14 is a top view illustrating a temporary retainer according to Example 4.
Figure 15:
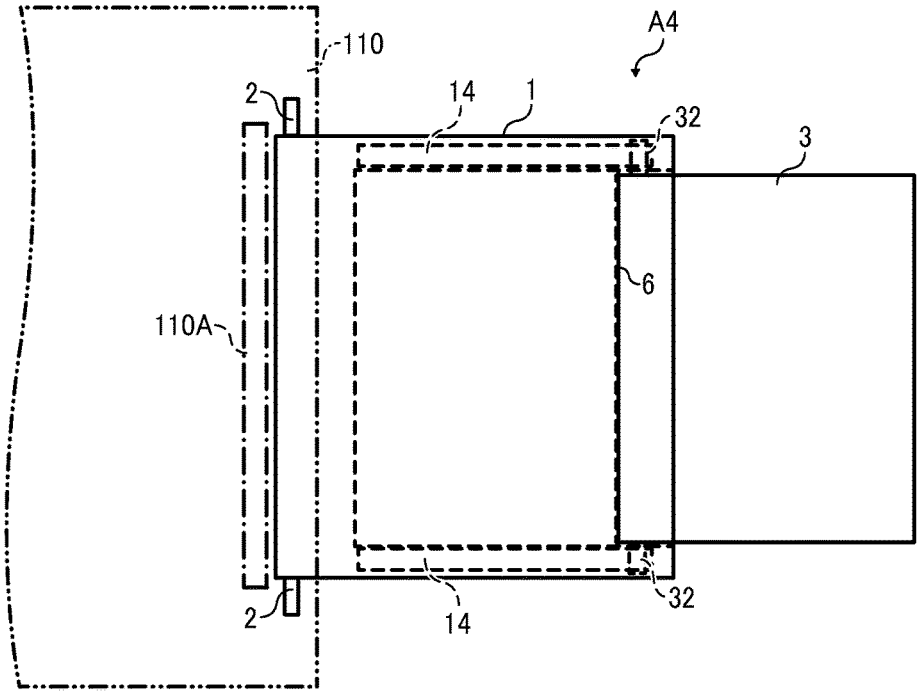
FIG. 15 is a bottom view illustrating the temporary retainer of Example 4.
Figure 16:
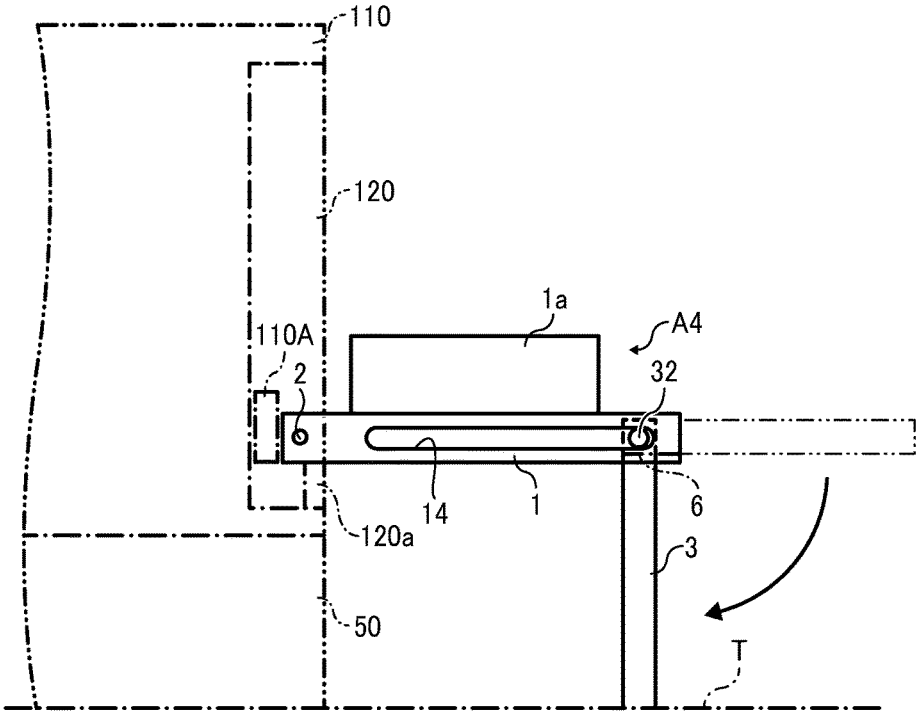
FIG. 16 is a front view illustrating a state of assembling of the temporary retainer of Example 4.

FIG. 14 is a top view illustrating the temporary retainer A4. FIG. 15 is a bottom view illustrating the temporary retainer A4. FIG. 16 is a front view illustrating a state of assembling of the temporary retainer A4.

Similar to Examples 1 through 3, the bypass tray 1 according to Example 4 rotates about the bypass tray movement support shaft 2 when the bypass tray 1 is not used. By so doing, the bypass tray 1 can be stored in the tray storing portion 120. The bypass tray 1 in Example 4 includes an extension tray 3 that is included in the temporary retainer A4. The extension tray 3 is slidably removable from the bypass tray 1 along a rail guide or rail guides.

Further, the extension tray 3 is freely slidably pulled within the range of the tray slidable range opening 14 on the bypass tray 1, as illustrated in FIG. 15.

A cut 6 is formed at an end of the back face of the bypass tray 1. An extension tray movement support shaft 32 is rotatably attached to the extension tray 3. At the time of failure of the assembling portion of the bypass tray movement support shaft 2, the following processes are taken.

As the extension tray 3 is pulled out from the bypass tray 1, the extension tray movement support shaft 32 that functions as an extension tray rotation support moves to a position where the cut 6 is formed. By so doing, the extension tray 3 can rotate and turn downwardly. That is, as illustrated in FIG. 15, the extension tray 3 is pulled out to the right end portion of the tray slidable range opening 14 to the maximum extent, which is, to a most extendable position. Then, as illustrated in FIG. 16, the extension tray 3 rotates about the extension tray movement support shaft 32 by substantially 90 degrees. By so doing, the extension tray 3 is turned to be vertical to the table T that is a ground surface of the apparatus body 110.

It is to be noted that the end portion of the bypass tray 1 is fitted into the tray storing portion 120 of the apparatus body 110, so that the bypass tray 1 is supported while being in contact with the frame 120*a* of the tray storing portion 120. As described above, the extension tray 3 functions as a leg in Example 4. Accordingly, the extension tray 3 can position the bypass tray 1 in the vertical direction DH relative to the apparatus body 110. In that case, the height of the bypass tray 1 is previously determined to be a height from the top face of the table T including the sheet bank 50. Accordingly, the bypass tray 1 can be positioned in the vertical direction DH relative to the apparatus body side sheet insertion port 110A of the apparatus body 110 and in the perpendicular direction to the sheet conveying direction DA.

Example 5

A description is given of the temporary retainer A5 according to Example 5, with reference to FIGS. 17 through 21.

Figure 17:
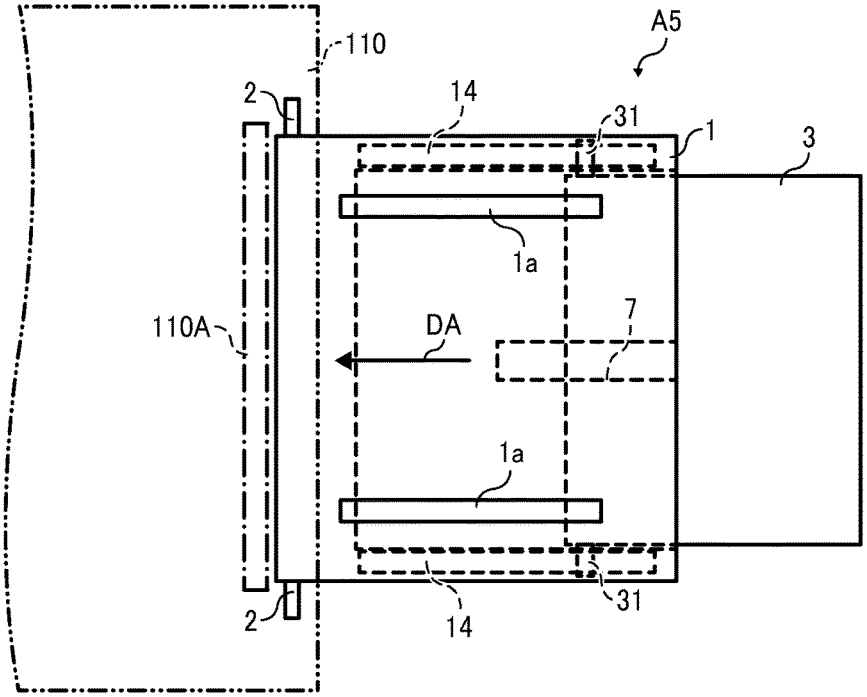
FIG. 17 is a top view illustrating a temporary retainer according to Example 5.
Figure 18:
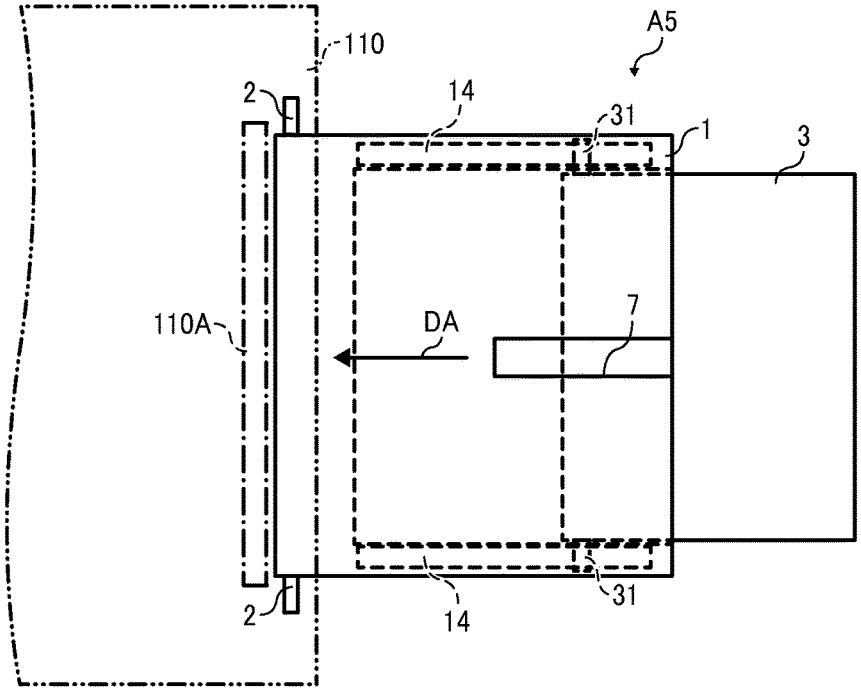
FIG. 18 is a bottom view illustrating the temporary retainer of Example 5.
Figure 19:
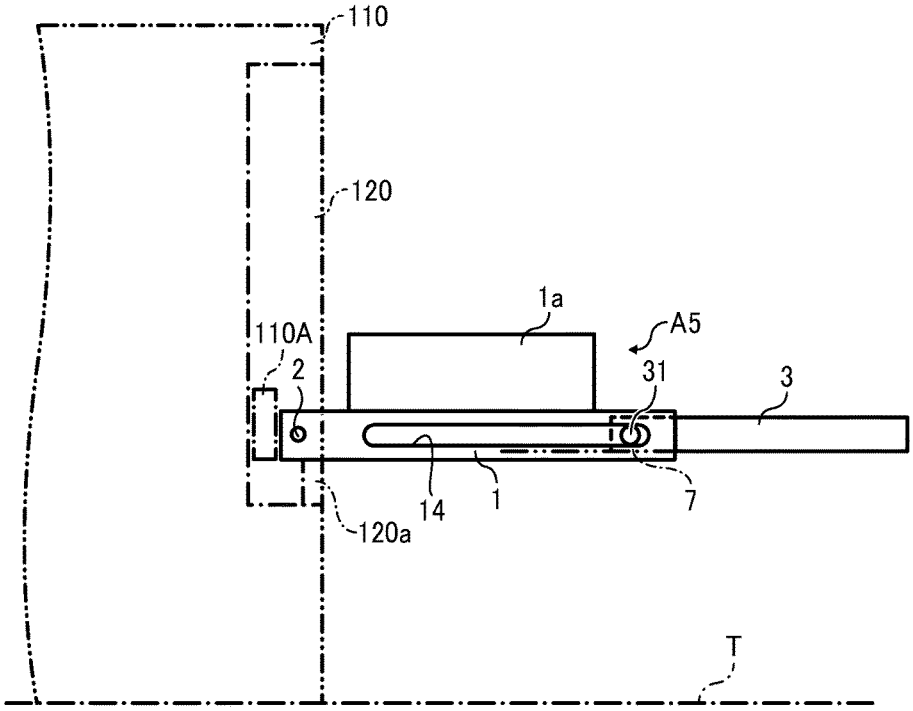
FIG. 19 is a front view illustrating the temporary retainer of Example 5 in the first state.
Figure 20:
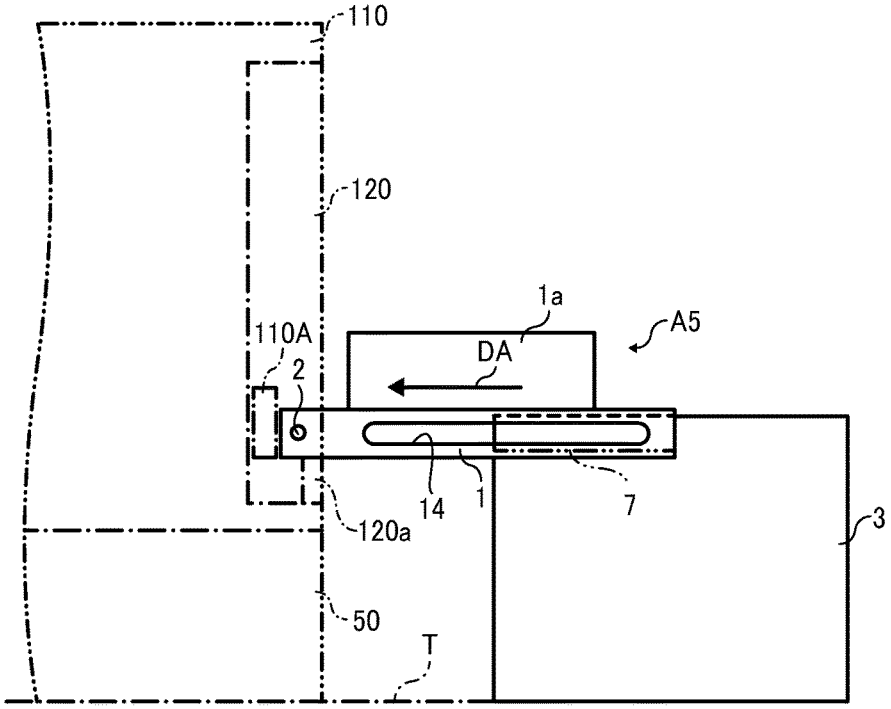
FIG. 20 is a front view illustrating the temporary retainer of Example 5 in the second state.
Figure 21:
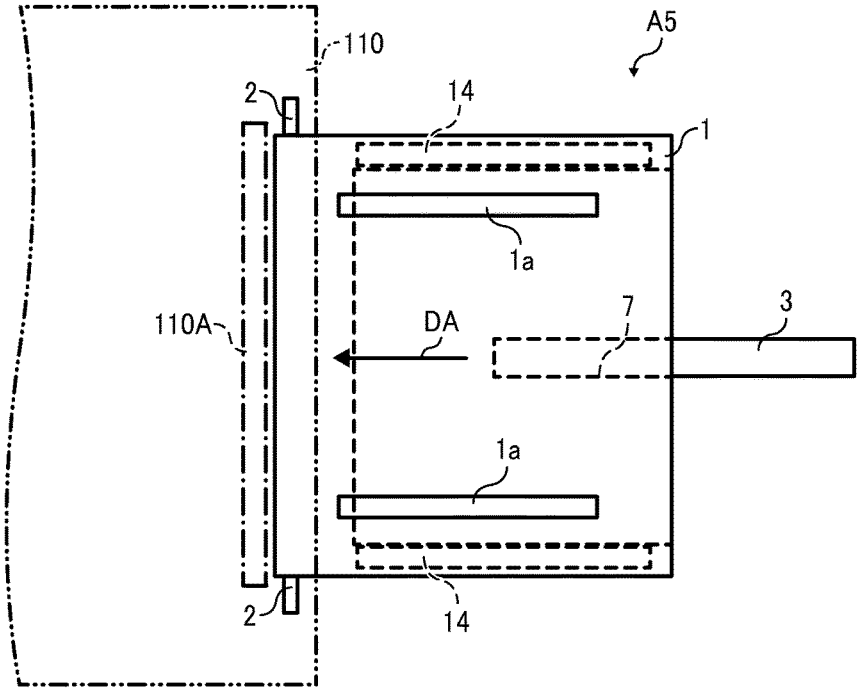
FIG. 21 is a top view illustrating the temporary retainer of Example 5 in the second state.

FIG. 17 is a top view illustrating the temporary retainer A5. FIG. 18 is a bottom view illustrating the temporary retainer A5. FIG. 19 is a front view illustrating the temporary retainer A5 in the first state. FIG. 20 is a front view illustrating the temporary retainer A5 in the second state. FIG. 21 is a top view illustrating the temporary retainer A5 in the second state.

Example 5 is a variation of Example 2. Similar to Example 2, the bypass tray 1 according to Example 5 rotates about the bypass tray movement support shaft 2 when the bypass tray 1 is not used. By so doing, the bypass tray 1 can be stored in the tray storing portion 120. The extension tray 3 that is included in the temporary retainer A5 is slidably removable from the bypass tray 1 along a rail guide or rail guides. The extension tray 3 is freely slidably pulled out within the range of the tray slidable range opening 14 on the bypass tray 1. The respective screws 31 mounted on the extension tray 3 contact the right end portion of the tray slidable range opening 14, as illustrated in FIG. 19. Accordingly, detachment of the extension tray 3 can be prevented. By removing the screws 31 from the extension tray 3, the extension tray 3 can be removed from the bypass tray 1.

An extension tray insertion opening 7 is formed (disposed) on the back face (the opposite face) of the bypass tray 1. A longitudinal direction of the extension tray insertion opening 7 corresponds to the sheet conveying direction. At the time of failure of the assembling portion of the bypass tray movement support shaft 2, the following processes are taken.

As illustrated in FIG. 20, the end portion of the bypass tray 1 is fitted into the tray storing portion 120 of the apparatus body 110, so that the bypass tray 1 is supported while being in contact with the frame 120*a* of the tray storing portion 120. The extension tray 3 removed from the bypass tray 1 is fitted into the extension tray insertion opening 7, so that the extension tray 3 can position the bypass tray 1 in the vertical direction DH from the table T. That is, the extension tray 3 is fitted to the extension tray insertion opening 7 in the sheet conveying direction. At this time, the extension tray 3 functions as a leg. By so doing, the bypass tray 1 is positioned in the vertical direction DH relative to the apparatus body 110. In that case, the height of the bypass tray 1 is previously determined to be a height from the top face of the table T including the sheet bank 50. Accordingly, the bypass tray 1 can be positioned in the vertical direction DH relative to the apparatus body side sheet insertion port 110A of the apparatus body 110 and in the perpendicular direction to the sheet conveying direction DA.

The extension tray insertion opening 7 is formed or disposed on an opposite side (an upstream side) of the bypass tray 1 in the sheet conveying direction. In other words, the extension tray insertion opening 7 is formed on a far side of the bypass tray 1 from the apparatus body 110. That is, the extension tray 3 lands or touches the ground at the opposite side (the upstream side) of the bypass tray 1 in the sheet conveying direction. In other words, the extension tray 3 lands or contacts the ground at the far side of the bypass tray 1 from the apparatus body 110.

Further, as illustrated in FIGS. 20 and 21, the extension tray 3 is fitted to the extension tray insertion opening 7 so that the extension tray 3 can be slidably pulled out from the bypass tray 1. According to this configuration, when a long length sheet is set on the bypass tray 1, the long length sheet can be rested on the extension tray 3 that functions as a leg, thereby preventing the long length sheet from falling from the bypass tray 1.

Example 6

Figure 22:
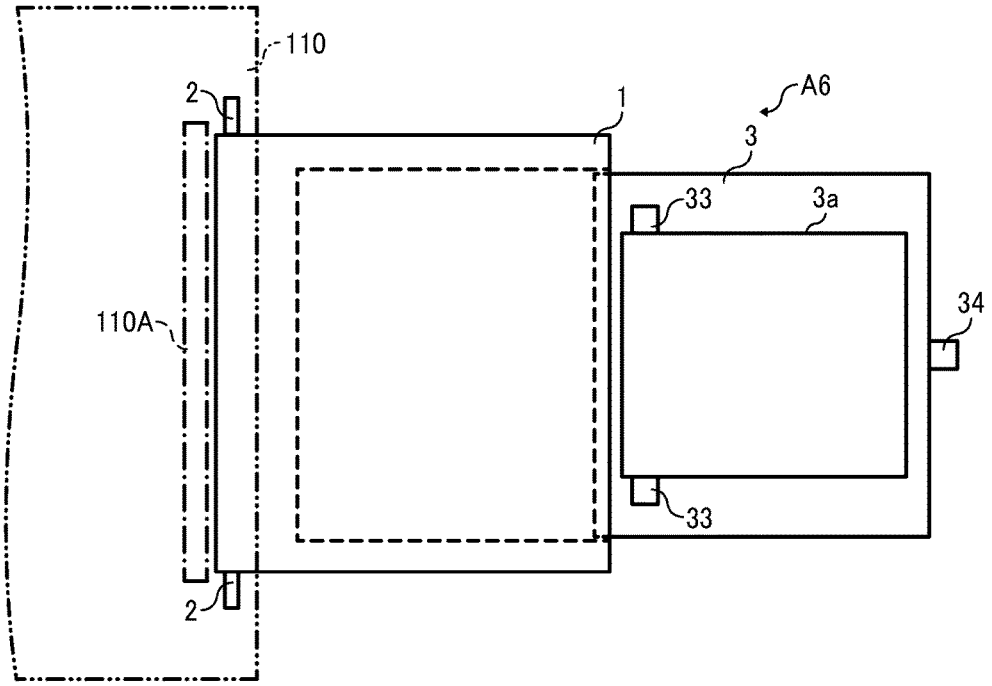
FIG. 22 is a top view illustrating a temporary retainer according to Example 6.
Figure 23:
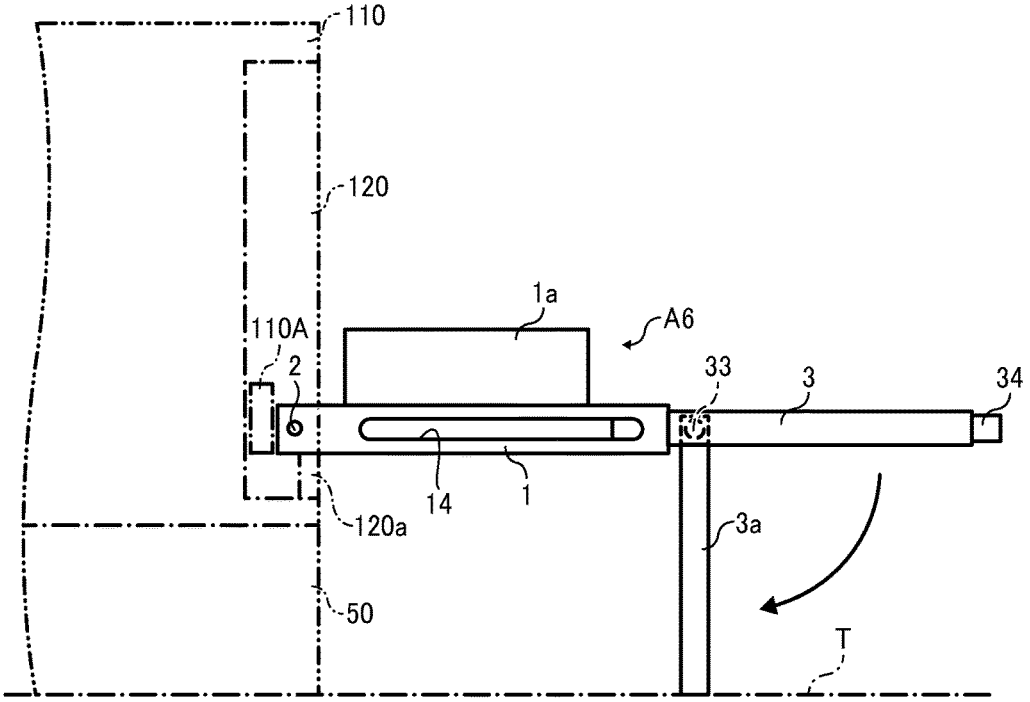
FIG. 23 is a front view illustrating a state of assembling of the temporary retainer of Example 6.

A description is given of the temporary retainer A6 according to Example 6, with reference to FIGS. 22 and 23.

FIG. 22 is a top view illustrating the temporary retainer A6. FIG. 23 is a front view illustrating a state of assembling of the temporary retainer A6.

Similar to Examples 1 through 5, the bypass tray 1 according to Example 6 rotates about the bypass tray movement support 2 when the bypass tray 1 is not used. By so doing, the bypass tray 1 can be stored in the tray storing portion 120. Further, the extension tray 3 is stowed in the bypass tray 1 to be slidably removable from the bypass tray 1 along a rail guide or rail guides.

An internal moving body 3*a* is disposed inside the extension tray 3 of Example 6. The internal moving body 3*a* is supported by a tray movement support shaft 33 that functions as an extension tray rotation support. The extension tray 3 further includes a thumbscrew 34 attached at an end thereof. Removal of the thumbscrew 34 from the extension tray 3 can release the internal moving body 3*a*, so that the internal moving body 3*a* can rotate about the tray movement support shaft 33. By rotating downwardly about the tray movement support shaft 33, the internal moving body 3*a* can function as a leg to support the extension tray 3. FIG. 22 illustrates a closed state of the internal moving body 3*a* stowed in the extension tray 3 and FIG. 23 illustrates an open state of the internal moving body 3*a* rotated downwardly to serve as a leg.

As described above, the internal moving body 3*a* that is included in the extension tray 3 is rotated by substantially 90 degrees, so that the height of the extension tray 3 can be maintained. In this case, the height of the bypass tray 1 is previously determined to be a height from the top face of the table T including the sheet bank 50. Therefore, even at the time of failure of the assembling portion of the bypass tray movement support shaft 2, the end portion of the bypass tray 1 is supported while being in contact with the frame 120*a* of the tray storing portion 120, therefore the internal moving body 3*a* can hold the bypass tray 1 to prevent the bypass tray 1 from falling. Accordingly, the bypass tray 1 can be positioned in the vertical direction DH relative to the apparatus body side sheet insertion port 110A of the apparatus body 110 and in the perpendicular direction to the sheet conveying direction DA.

As described in Examples 1 through 6, the respective positions of the bypass tray 1 relative to the apparatus body 110 of the image forming apparatus 100 are determined according to the following configuration. The position in height of the bypass tray 1 to convey a sheet (e.g., the sheet P) is determined by contacting the end portion of the bypass tray 1 with the frame 120*a* located at the lower part of the tray storing portion 120 of the apparatus body 110. The position of the bypass tray 1 in the direction perpendicular to the sheet conveying direction DA is determined by contacting the lower edge of the opening of the tray storing portion 120. Specifically in Example 1, the projection 13 is fitted to the recessed portion 11*a* of the recess 11. By so doing, the position of the bypass tray 1 in the direction perpendicular to the sheet conveying direction DA can be positioned.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. An image forming apparatus comprising:

an apparatus body;

an image forming portion located in the apparatus body to form an image on a recording medium;

a sheet feeding port upstream from the image forming portion of the apparatus body in a sheet feeding direction;

a bypass tray configured to be stored in the apparatus body, the bypass tray configured to load the recording medium to be fed toward the sheet feeding port;

a rotation support configured to support the bypass tray;

a temporary retainer to position the bypass tray both in a vertical direction relative to the sheet feeding port and in a perpendicular direction relative to the sheet feeding direction; and a pair of supports on a rear face of the bypass tray, wherein the temporary retainer is configured to temporarily retain the bypass tray, wherein the temporary retainer includes:

a recess facing the sheet feeding port; and a rotatable projection on the bypass tray configured to fit into the recess, the rotatable projection being rotatable independently of the bypass tray, the rotatable projection including a support shaft, the rotatable projection being supported by the pair of supports so as to be rotatable about the support shaft around an axis.

2. The image forming apparatus according to claim 1, wherein the bypass tray is positioned in a horizontal direction by fitting of the recess and the rotatable projection to each other.

3. The image forming apparatus according to claim 1, wherein the recess includes a recessed portion.

4. The image forming apparatus according to claim 3, wherein recess portion has a substantially rectangular shape, and the rotatable projection has a substantially rectangular shape to fit into the recessed portion.

5. The image forming apparatus according to claim 3, wherein the recess includes a step at an edge of the recessed portion, and wherein the rotatable projection includes a step at an edge thereof to fit to the step of the recess portion.

6. The image forming apparatus according to claim 5, wherein the rotatable projection is configured to contact a lower edge of an opening of a tray storing portion of the apparatus body.

7. The image forming apparatus according to claim 5, wherein the rotatable projection and the bypass tray are supported by the step of the recess and a lower edge of an opening of a tray storing portion of the apparatus body.

8. The image forming apparatus according to claim 1, wherein the pair of supports include a ratchet wheel to be mounted on a support shaft to hold a state in which the rotatable projection projects from the bypass tray.

9. An image forming apparatus comprising:

an apparatus body;

an image forming portion located in the apparatus body to form an image on a recording medium;

a sheet feeding port upstream from the image forming portion of the apparatus body in a sheet feeding direction;

a bypass tray configured to be stored in the apparatus body, the bypass tray configured to load the recording medium to be fed toward the sheet feeding port;

a rotation support configured to support the bypass tray; and a temporary retainer to position the bypass tray both in a vertical direction relative to the sheet feeding port and in a perpendicular direction relative to the sheet feeding direction, the temporary retainer including, an extension tray detachably attached to the bypass tray, and an extension tray insertion opening on an opposite face to a face of the bypass tray on which the recording medium is loaded, the extension tray insertion opening extending in either one of a sheet conveying direction and the perpendicular direction, wherein the temporary retainer is configured to temporarily retain the bypass tray, and wherein the bypass tray is positioned in the vertical direction by detachment of the extension tray from the bypass tray and insertion of the extension tray into the extension tray insertion opening.

10. The image forming apparatus according to claim 9, wherein the extension tray is inserted into the extension tray insertion opening on an upstream side of the bypass tray relative to the apparatus body in the sheet conveying direction.

11. The image forming apparatus according to claim 9, wherein the temporary retainer includes a leg detachably attachable to the bypass tray, wherein the leg has a recess to which the bypass tray is fitted, and wherein the bypass tray is positioned in the vertical direction relative to the sheet feeding port of the apparatus body by detachment of the leg from the bypass tray and insertion of the leg to the bypass tray at the recess.

12. An image forming apparatus comprising:

an apparatus body;

an image forming portion located in the apparatus body to form an image on a recording medium;

a sheet feeding port upstream from the image forming portion of the apparatus body in a sheet feeding direction;

a bypass tray configured to be stored in the apparatus body, the bypass tray configured to load the recording medium to be fed toward the sheet feeding port;

a rotation support configured to support the bypass tray; and a temporary retainer to position the bypass tray both in a vertical direction relative to the sheet feeding port and in a perpendicular direction relative to the sheet feeding direction, the temporary retainer including, an extension tray detachably attached to the bypass tray, and an extension tray rotation support rotatably attached to the extension tray, wherein, the temporary retainer is configured to temporarily retain the bypass tray, wherein, when the extension tray is pulled out to a most extendable position, the extension tray rotates about the extension tray rotation support, and wherein, when the extension tray is rotated to be vertical to contact a surface on which the apparatus body is set, the bypass tray is positioned in the vertical direction relative to the sheet feeding port.

13. The image forming apparatus according to claim 12, wherein the extension tray includes an internal moving body configured to be rotatable when the extension tray is pulled out to a most extendable position from the bypass tray.

* * * * *